US005449013A

United States Patent [19]

Landers

[11] Patent Number: 5,449,013

[45] Date of Patent: Sep. 12, 1995

[54] DEVICE FOR ASSISTING A PERSON TO SIT OR STAND

[75] Inventor: Allan L. Landers, Honesdale, Pa.

[73] Assignee: Dawn Landers, Lake Ariel, Pa.

[21] Appl. No.: 130,316

[22] Filed: Oct. 1, 1993

[51] Int. Cl.[6] ..... A61H 3/00

[52] U.S. Cl. ..... 135/67; 135/74

[58] Field of Search ..... 135/65, 66, 67, 72, 135/74

[56] References Cited

U.S. PATENT DOCUMENTS

| | | | |
|---|---|---|---|
| 2,596,055 | 5/1952 | Thomas | 135/67 |
| 2,757,388 | 8/1956 | Chisholm | 135/67 |
| 3,272,530 | 9/1966 | Klassen | 297/5 |
| 3,739,793 | 6/1973 | Wilson | 135/45 |
| 4,111,445 | 9/1978 | Haibeck | 297/5 |
| 4,314,576 | 2/1982 | McGee | 135/67 |
| 4,844,107 | 7/1989 | Watkins | 135/65 |
| 4,894,871 | 1/1990 | Schmeiler | 135/67 |
| 4,948,156 | 8/1990 | Fortner | 280/304.1 |
| 4,964,182 | 10/1990 | Schmerler | 5/81 R |
| 4,987,622 | 1/1991 | Shockey | 5/81 R |
| 4,995,412 | 2/1991 | Hirn | 135/67 |
| 5,007,618 | 4/1991 | Libby | 256/1 |
| 5,086,798 | 2/1992 | Motts | 135/67 |
| 5,188,139 | 2/1993 | Gavelick | 135/67 |
| 5,201,333 | 4/1993 | Shalmon | 135/67 |
| 5,226,439 | 7/1993 | O'Keefe | 135/66 |

*Primary Examiner*—Carl D. Friedman
*Assistant Examiner*—Beth A. Aubrey
*Attorney, Agent, or Firm*—Joseph W. Molasky & Associates

[57] ABSTRACT

A device for assisting a disabled person to rise from a seat to a standing position and for assisting a disabled person to sit from a standing position is provided. The device comprises a mat attached to floor rails which are attached to hand grips and forearm supports. In one embodiment, the device has a unitary construction, and in another embodiment, the device has a modular construction. The device is compatible for use with both wheelchairs and walkers.

16 Claims, 5 Drawing Sheets

DEVICE FOR ASSISTING A PERSON TO SIT OR STAND

BACKGROUND OF THE INVENTION

This invention relates to a device for assisting a disabled person to rise from a sitting position to a standing position and for assisting a person to lower from a standing position to a sitting position.

Many people suffer from medical conditions such as arthritis, muscular injury, muscular disease, back injuries, knee injuries, obesity, or simply advanced age which makes moving from a sitting to a standing or a standing to a sitting position difficult.

It is very trying for people who suffer from such conditions to sit down and rise from chairs, beds, sofas, and wheel chairs. As a result, disabled people often remain seated when, in fact, rising from a chair or a bed and walking would provide exercise to the disabled person.

There are a number of devices which have been utilized to assist disabled persons to sit and to rise. However, these devices have generally been so large in size as to be cumbersome, or have not been of sturdy construction to prevent a disabled person from falling when using the device. Additionally, some devices are not compatible for use with other disability aids such as wheel chairs and walkers.

Thus, a need exists for a device which allows a disabled person to rise from a seat to a standing position and to sit from a standing position without the device tipping over and yet is both portable and not cumbersome to move from one location to the next.

A need also exists for a device which allows a person to sit in and rise from chairs, sofas, and beds, and is compatible with both wheelchairs and walkers.

OBJECTS OF THE INVENTION

It is an object of this invention to provide a device which assists a disabled person to rise from a seat and to sit from a standing position which is stable and not prone to tipping over. It is also an object of this invention to provide a device which is portable and not cumbersome to move from one location to the next. It is also an object of this invention to provide a device which allows a person to rise from a seat into a walker and to sit in a seat from a walker. It is also an object of this invention to provide a device which assists a person to rise from a wheelchair to a standing position and to sit into a wheelchair from a standing position.

SUMMARY OF THE INVENTION

To achieve the foregoing objects of the invention as embodied and broadly described herein, the device comprises a mat having a non-skid top surface. A plurality of floor rails are attached to said mat. A plurality of forearm supports are attached to said floor rails. A plurality of hand grips are attached to said floor rails and are attached to said forearm supports, and a brace connects said forearm supports.

In one embodiment of the invention, the device has a unitary construction and comprises a mat having a right edge, a left edge, and a top side having a non-skid surface. A right floor rail is attached to said right edge of said mat and a left floor rail is attached to said left edge of said mat. A right forearm support is attached to said right rail and a left forearm support is attached to said left rail. A right hand grip is attached to said right floor rail and is attached to said right forearm support and a left hand grip is attached to said left floor rail and is attached to said left forearm support.

In another embodiment of the invention, the device has a modular construction comprising a mat having a right edge, a left edge, and a top side having a non-skid surface. A right floor rail is attached to said right edge of said mat and said right floor rail has a plurality of struts projecting from said floor rail, each said strut having a bore therethrough. A left floor rail is attached to said left edge of said mat and said left floor rail has a plurality of struts projecting from said floor rail, each said strut having a bore therethrough. A tubular right forearm support is attached to said right floor rail at one of said struts, said support having a pair of orifices alignable with said strut bore. A tubular left forearm support is attached to said left floor rail at one of said struts, said support having a pair of orifices alignable with said strut bore. A tubular right hand grip is attached to said right forearm support. Said tubular right hand grip is also attached to said right floor rail at one of said struts, said grip having a pair of orifices alignable with said strut bore. A tubular left hand grip is attached to said left forearm support, said tubular left hand grip is also attached to said left floor rail at one of said struts, said grip having a pair of orifices alignable with said strut bore. A brace connects said right and left tubular forearm supports. A plurality of pins is removably disposed within said orifices of said forearm supports and said hand grips and within said strut bores for securing said supports and said grips to said rails.

BRIEF DESCRIPTION OF THE DRAWINGS

The accompanying drawings, which are incorporated in and form a part of the specification, illustrate the embodiments of the present invention and together with the description serve to explain the principles of the invention.

In the drawings.

DESCRIPTION OF THE PREFERRED EMBODIMENT

Figure 1:
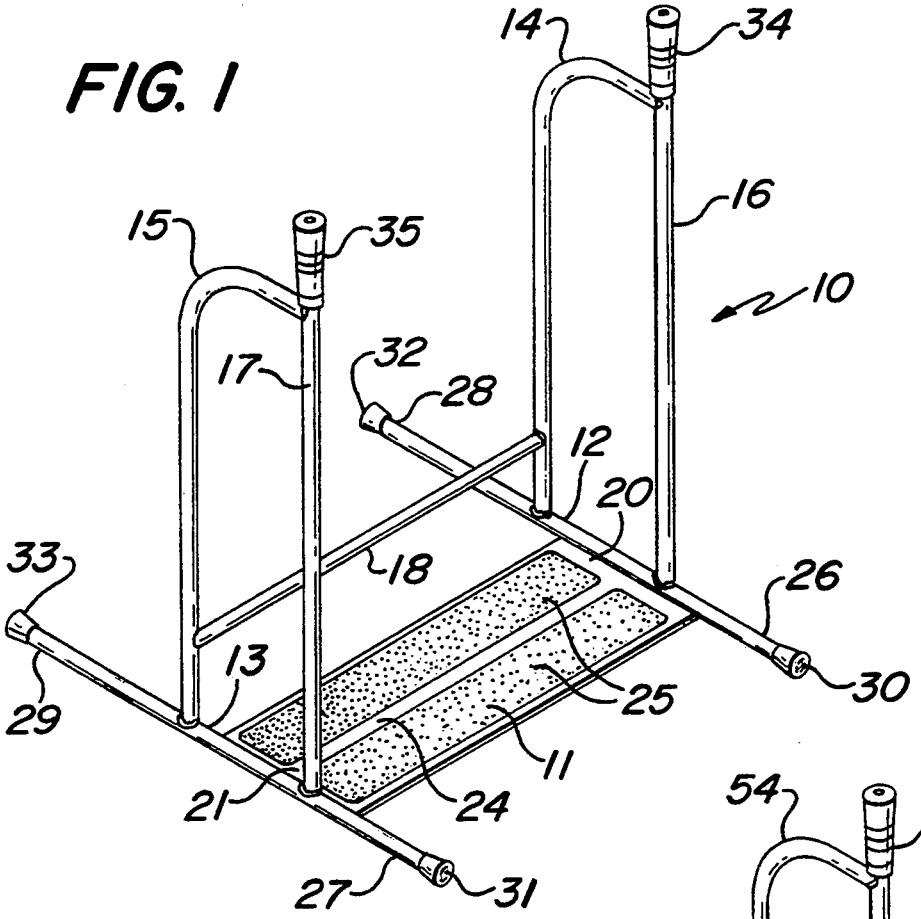
FIG. 1 is a perspective view illustrating a unitary embodiment of the device of the present invention.

The device of this invention is depicted generally as in FIG. 1. Device 10 is comprised of a mat 11, a plurality of floor rails 12 and 13, a plurality of forearm supports 14 and 15, a plurality of hand grips 16 and 17, and a brace 18 connecting the forearm supports 14 and 15. In the unitary constructed embodiment of this invention shown in FIG. 1, mat 11 has a left edge 20, a right edge 21, and a top side 24 having a non-skid surface 25. Floor rail 12 is attached to mat 11 along left edge 20. Floor rail 12 has a front end 26 and a back end 28 capped by polymeric end-caps 30 and 32. Floor rail 13 is attached to mat 11 along right edge 21. Floor rail 13 has a front end 27 and a back end 29 capped by polymeric end-caps 31 and 33. Forearm support 14 is attached to floor rail 12. Forearm support 15 is attached to floor rail 13 and both forearm supports are connected to brace 18 as shown in FIG. 1. Hand grip 16 is attached to floor rail 12 and to forearm support 14. Hand grip 17 is attached to floor rail 13 and to forearm support 15. Hand grips 16 and 17 have polymeric sleeves 34 and 35, respectively, to provide non-slip hand-hold surfaces for the users of device 10.

Figure 2:
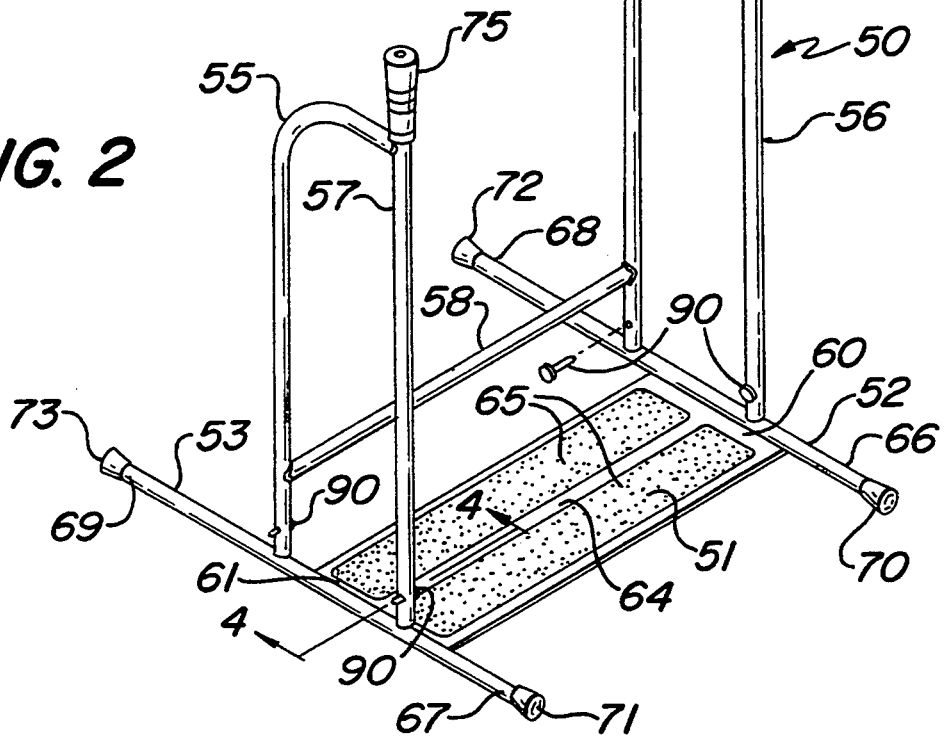
FIG. 2 is a perspective view illustrating a nonunitary embodiment of the device of the present invention.
Figure 3:
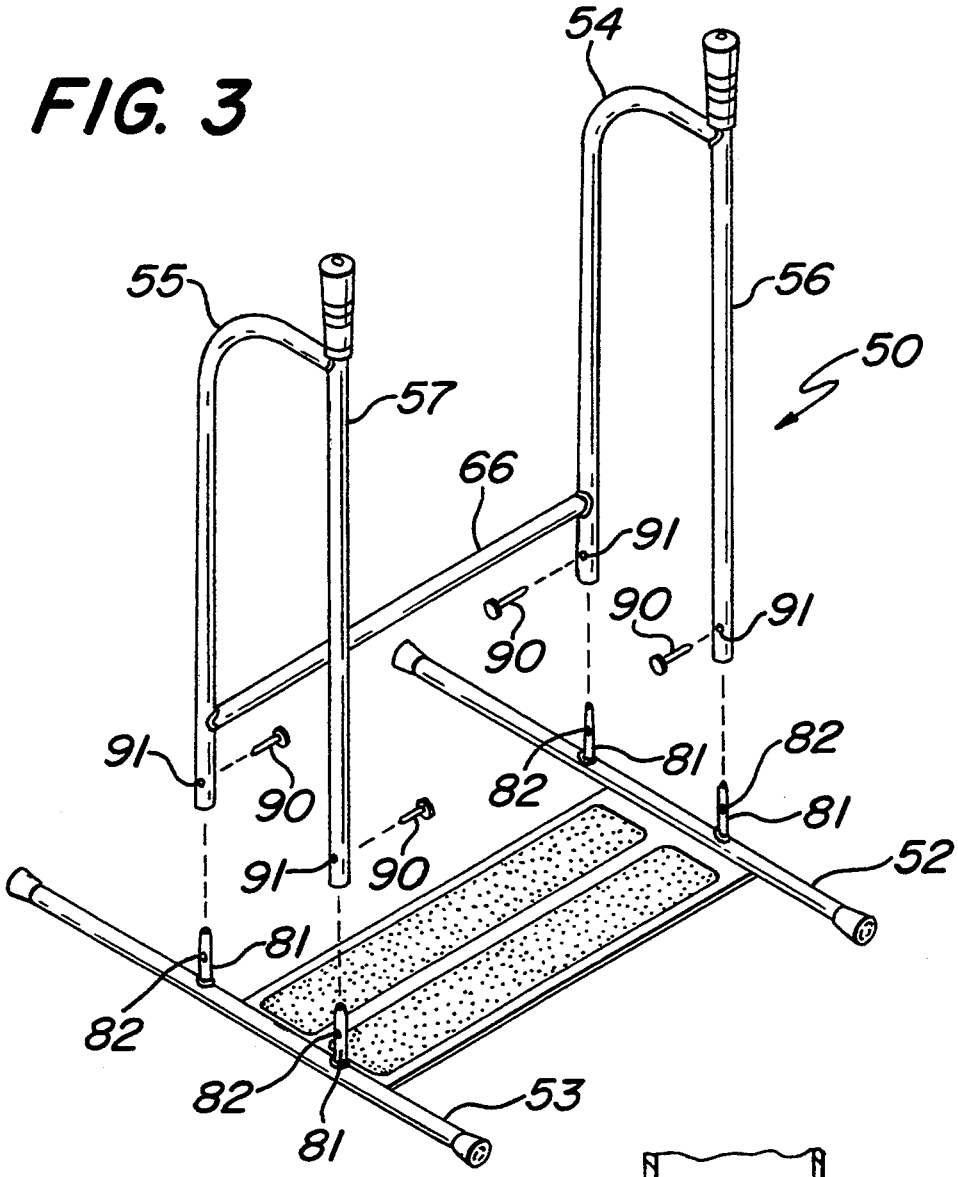
FIG. 3 is an exploded perspective view of the device illustrated in FIG. 2.
Figure 4:
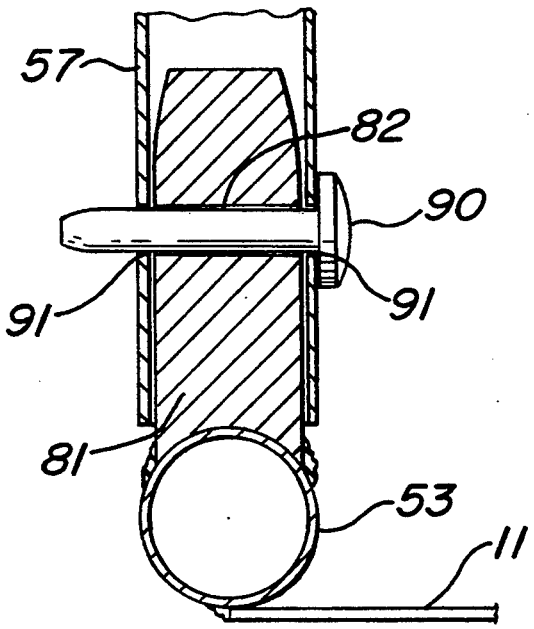
FIG. 4 is a partially cut-away sectional view of the device taken along line 4—4 of the device illustrated in FIG. 2.

FIGS. 2 and 3 illustrates another embodiment of the invention in which a device shown generally as 50 has a modular construction. Device 50 is comprised of a mat 51, a plurality of floor rails 52 and 53, a plurality of forearm supports 54 and 55, a plurality of hand grips 56 and 57, and a brace 58 connecting the forearm grips 54 and 55. Mat 51 has a left edge 60, a right edge 61 and a top side 64 having a non-skid surface 65. Floor rail 52 is attached to mat 51 along left edge 60. Floor rail 52 has a front end 66 and a back end 68 capped by polymeric end-caps 70 and 72. Floor rail 53 is attached to mat 51 along right edge 61. Floor rail 53 has a front end 67 and a back end 69 capped by polymeric end-caps 71 and 73. Forearm support 54 is attached to floor rail 52. Forearm support 55 is attached to floor rail 53 and both forearm supports are connected to brace 58 as shown in FIG. 1. Hand grip 56 is attached to floor rail 52 and to forearm support 54. Hand grip 57 is attached to floor rail 53 and to forearm support 55. Hand grips 56 and 57 have polymeric sleeves 74 and 75, respectively, to provide non-slip hand-hold surfaces for the users of device 50. Device 50 is further comprised of a plurality of struts 81 having bores 82 therethrough shown in FIGS. 3 and 4. Struts 81 project from rails 52 and 53 and are insertable into tubular hand grips 56 and 57 and tubular forearm supports 54 and 55 having orifices 91 as shown in FIGS. 2–4. Orifices 91 are alignable with bores 82. Pins 90 are removably disposed within orifices 91 and bores 82 to secure hand grips 56 and 57 and forearm supports 54 and 55 to rails 52 and 53. The pin 90, orifice 91, bore 82, strut 91, rail 53, hand grip 57, and mat 51 arrangement is shown in detail in FIG. 4. The forearm supports and hand grips are described in the preferred embodiment as being attached to the floor rails and the mat via the aforementioned pin and strut arrangement. However, any attachment means could be utilized to attach the brace to the forearm supports; the forearm supports to the hand grips; the floor rails to the mat; and the brace, supports and grips to the rails and mat; and still be within the scope of this invention so long as the device is modularly constructed. Suitable attachment means include but are not limited to nuts and bolts, cotter pins and screws. The modular construction of device 50 allows device 50 to be packaged and transported in disassembled pieces, such as in a kit, which is assembled after arrival at it's destination. Thus, the modular construction of device 50 allows for greater ease of shipping than the unitarily constructed device 10.

Figure 5:
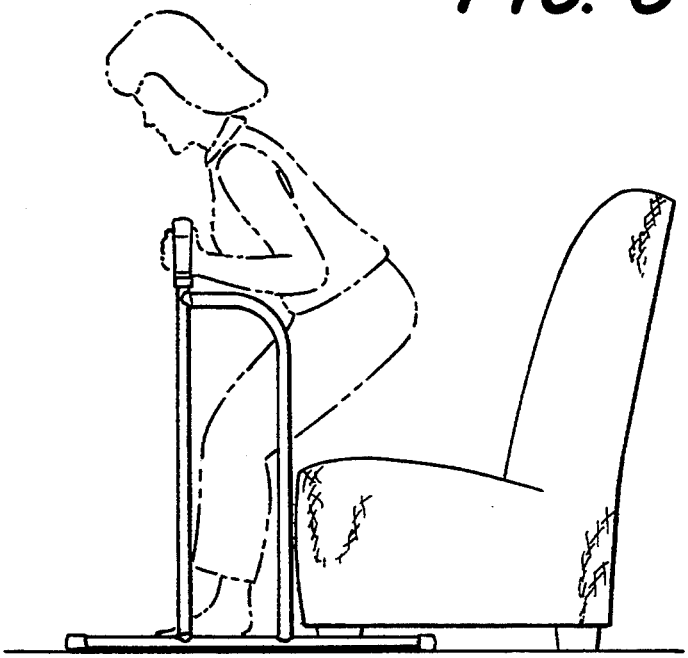
FIG. 5 is a side view illustrating a person utilizing the device with a chair.
Figure 6:
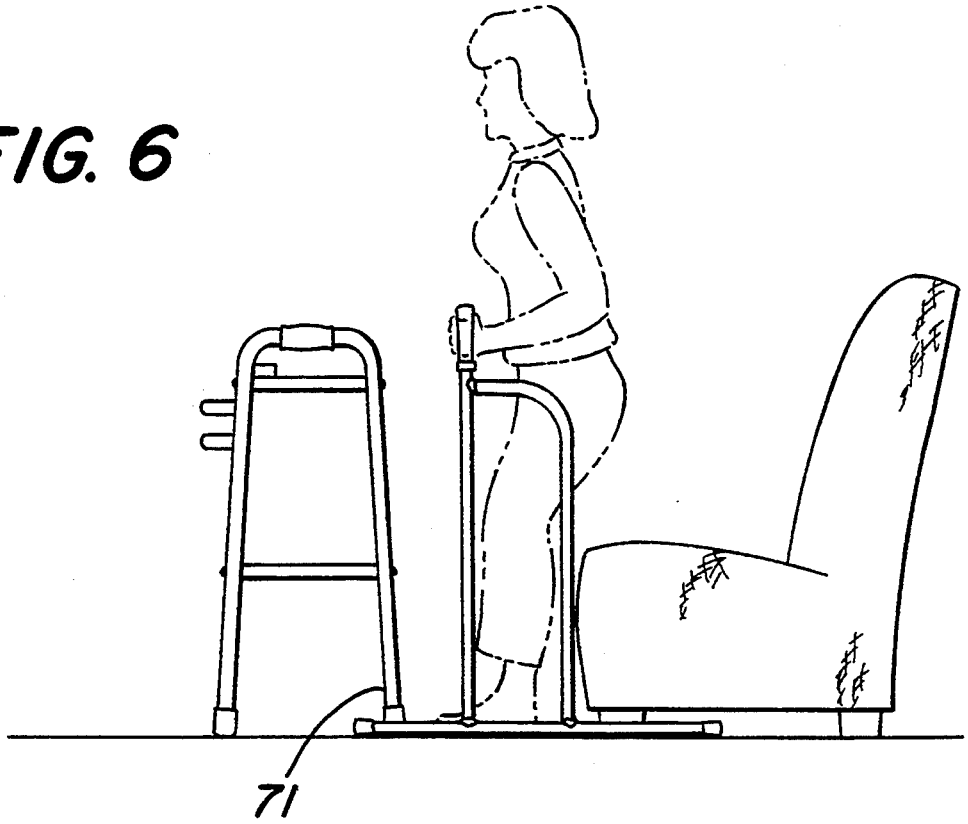
FIG. 6 a side view illustrating a person utilizing the device with a walker and a chair.

This invention is utilized as shown in FIGS. 5–10. To utilize the device to rise from a chair, a person grasps the polymeric sleeves on the hand grips with both hands while resting both forearms on the forearm supports and while placing both feet on the mat. A person then pulls their posterior from the seat, using their arms as shown in FIG. 5, while shifting their posterior from above the seat to above their feet, thus, achieving a standing position as shown in FIG. 6.

To sit, a person grasps both polymeric sleeves on the hand grips while standing on the mat as shown in FIG. 6. The person then crouches slightly while resting both forearms on the forearm supports and shifts their posterior from over their feet to over the seat as shown in FIG. 5. A person then utilizes their arms to lower their posterior into the seat, thus, achieving a sitting position.

Figure 7:
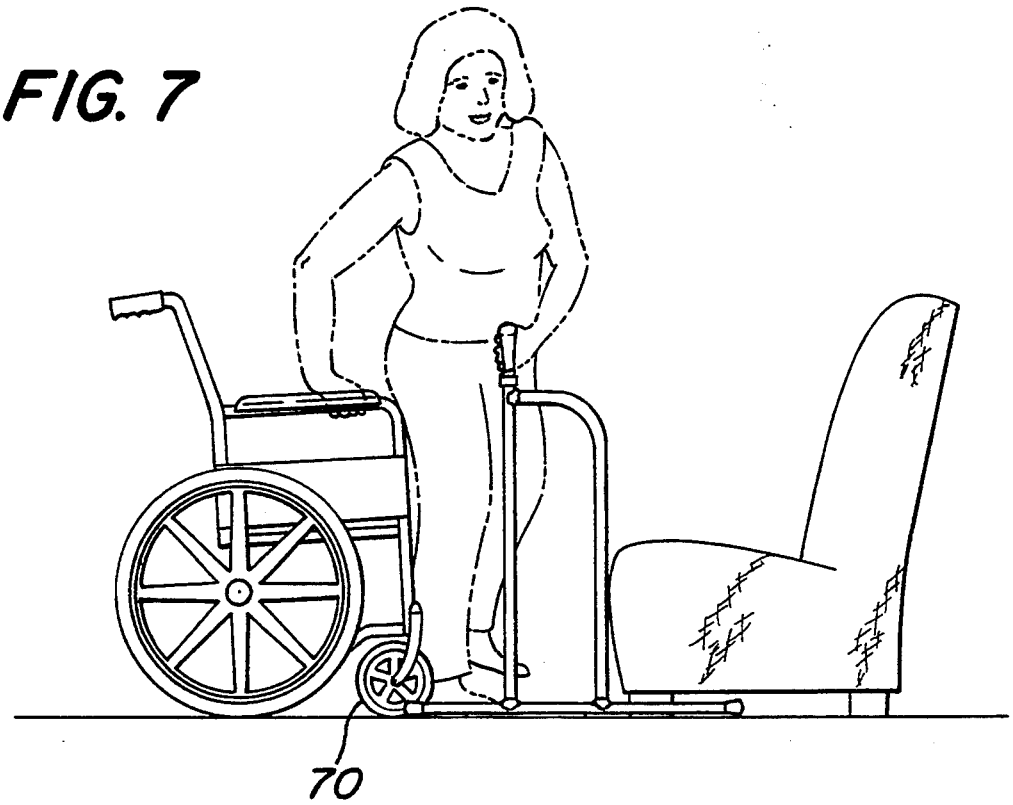
FIG. 7 is a side view illustrating a person utilizing the device with a wheelchair and a chair.
Figure 8:
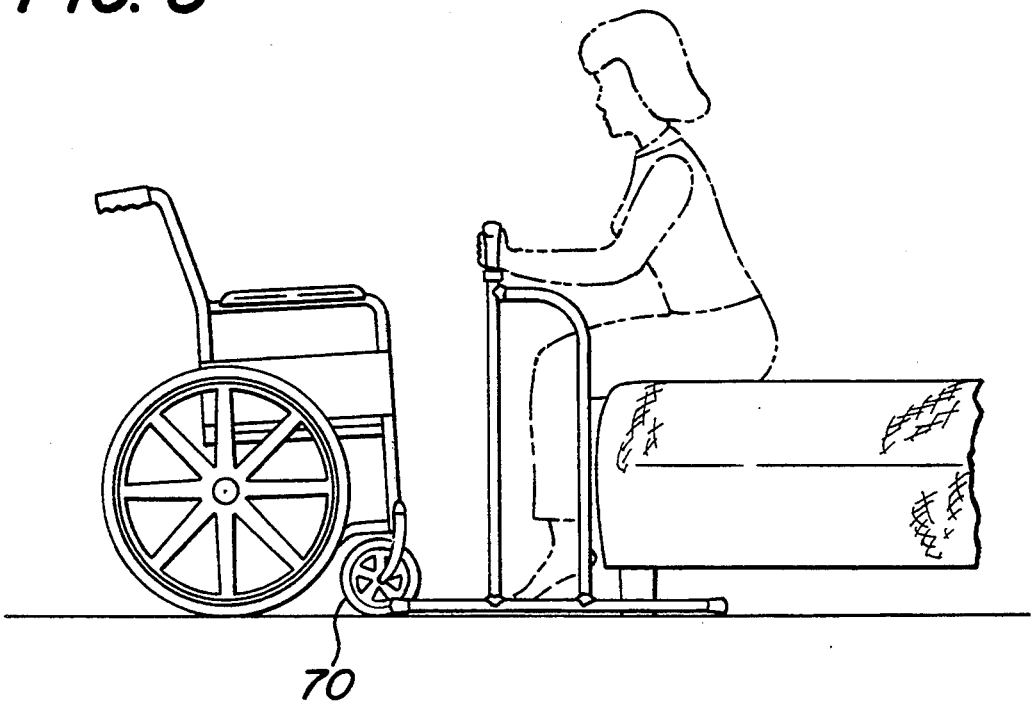
FIG. 8 is a side view illustrating a person utilizing the device with a wheelchair and a bed.
Figure 9:
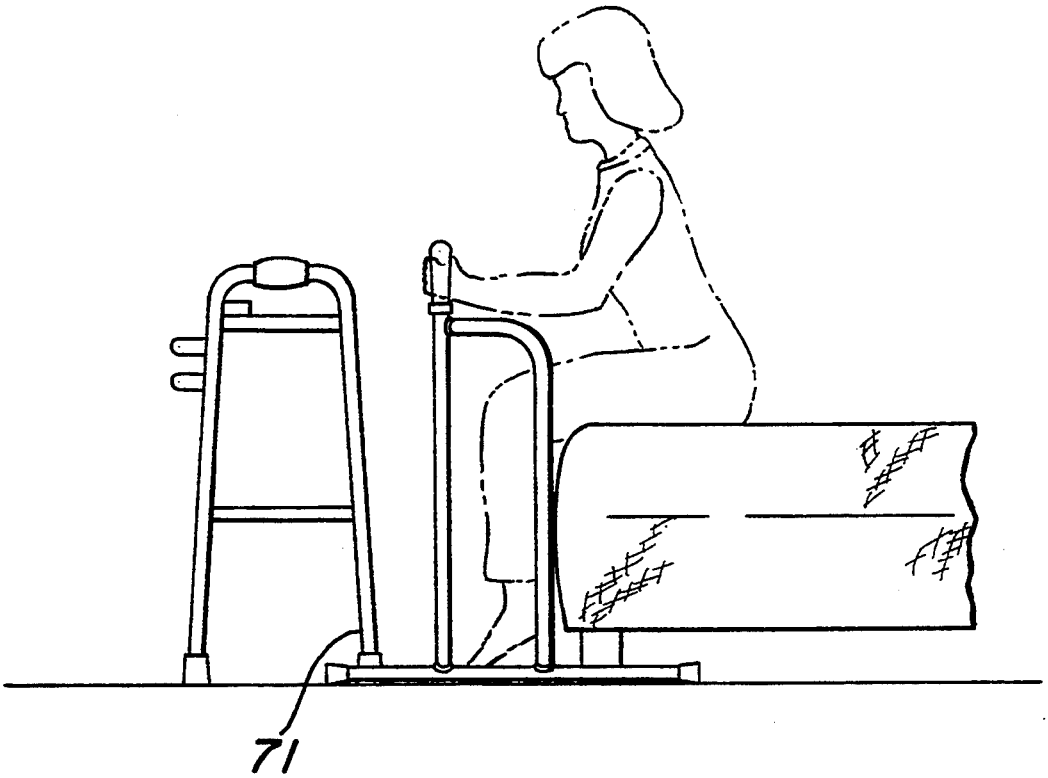
FIG. 9 is a side view illustrating a person utilizing the device with a walker and a bed.
Figure 10:
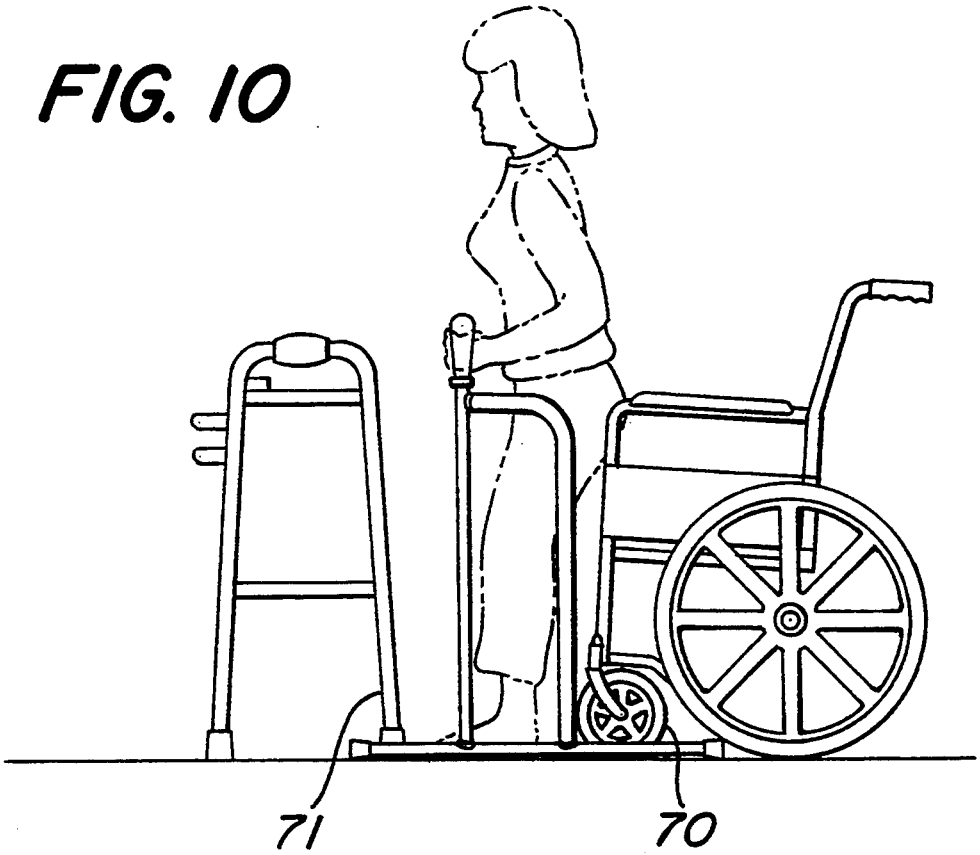
FIG. 10 is aside view illustrating a person utilizing the device with a walker and a wheelchair.

The device has several important features which enhance the devices usefulness. The device is small enough to portable and yet is large enough to be stable during use. The distance between the floor rails is sufficient to accommodate both the front wheels of a wheelchair 70 as shown in FIGS. 7, 8, and 10, as well as both legs 71 of a walker as shown in FIGS. 6, 9, and 10. These features allow the device user the freedom and flexibility to rise from and sit on a variety of chairs and beds and conveniently utilize both wheel chairs and walkers in cooperation with the device.

The floor rails, which extend in front and in back of the device, allow the user to lean forward and backward without fear of falling so long as the user grasps the hand grips and keeps both feet on the mat. The mat is located between the hand grips, the forearm supports, and the floor rails in a location which ensures that, when a person stands on the mat, the person's body weight anchors the device in one solid position during use of the device to prevent the device from tipping over and causing the user to fall. This solid stability instills confidence in the device user that they will not fall, thus, increasing the possibility that a disabled person in need of exercise will use the device.

Finally, the device is constructed of solid, durable materials such as tubular steel to provide the strength needed to allow a device user to pull themselves into a standing position from a seat and to lower themselves into a seat from a standing position without the device failing structurally.

Thus, this invention provides a device which assists a disabled person to rise from a seat and to sit from a standing position. The device is sturdily constructed and is not prone to tipping over. The device is also compact and portable to facilitate movement of the device from one seat to the next and can be utilized in conjunction with both wheelchairs and walkers.

While the preferred embodiments have been fully described and depicted for the purposes of explaining the principles of the present invention, it will be appreciated by those skilled in the art that modifications, and changes may be made thereto without departing from the scope of the invention set forth in the appended claims.

I claimed:

1. A step-through device for assisting a person to rise from a sitting position to a standing position and for assisting said person to lower from a standing to a sitting position, said device comprising:

a mat to be stood upon and having a non-skid top surface;

a plurality of floor rails attached to and extending beyond said mat;

a plurality of forearm supports attached to said floor rails;

a plurality of hand grips attached to said floor rails, said grips attached to said forearm supports and terminating in sleeves which extend upwardly beyond said forearm supports; and a brace connecting said forearm supports.

2. The device of claim 1 wherein said device has a unitary construction wherein said mat has a right edge and a left edge;

said floor rails are a right floor rail attached to said right edge of said mat, and a left floor rail attached to said left edge of said mat;

said forearm supports are a right forearm support attached to said right floor rail and a left forearm support attached to said left floor rail; and said hand grips are a right hand grip attached to said right floor rail and attached to said right forearm support and a left hand grip attached to said left floor rail and attached to said left forearm support.

3. The device of claim 2 wherein said left and right hand supports have polymeric sleeves.

4. The device of claim 2 wherein said right floor rail is further comprised of a front end and a back end having polymeric end-caps and wherein said left floor rail is further comprised of a front end and a back end having polymeric end-caps.

5. The device of claim 1 wherein said device has a modular construction wherein said mat has a right edge and a left edge, said floor rails are a right floor rail attached to said right edge of said mat and a left floor rail attached to said left edge of said, said right floor rail having a plurality of struts projecting from said floor rail, each said strut having a bore therethrough, said left floor rail having a plurality of struts projecting from said floor rail, each said strut having a bore therethrough; said forearm supports are a tubular right forearm support attached to said right floor rail at one of said struts and a tubular left forearm support attached to said left floor rail at one of said struts, said right forearm support having a pair of orifices alignable with said strut bore and said left forearm support having a pair of orifices alignable with said strut bore; said hand grips are a tubular right hand grip attached to said right floor rail at one of said struts and a tubular left hand grip attached to said left floor rail at one of said struts said right hand grips attached to said right forearm support, said right hand grip having a pair of orifices alignable with said strut bore; said left hand grip attached to said left forearm support, said left hand grip having a pair of orifices alignable with said strut bore; and wherein said device further comprises a plurality of pins removably disposed within said orifices of said forearm supports and said hand grips and within said strut bores for securing said supports and said grips to said rails.

6. The device of claim 5 wherein said left and right hand grips have polymeric sleeves.

7. The device of claim 5 wherein said right floor rail is further comprised of a front end and a back end, each said end having polymeric end-caps and wherein said left floor rail is further comprised of a front end and a back end, each said end having polymeric end-caps.

8. The device of claim 1 wherein said floor rails are compatible with wheelchairs and walkers.

9. The device of claim 1 wherein said brace is connected to said forearm supports at their lower portions below the waist level of the user so as to allow said user to walk through said device.

10. The device of claim 9 wherein said brace connecting said forearm supports is located rearwardly of said device.

11. The device of claim 5 wherein said strut associated with said tubular right forearm support is inserted into said tubular right forearm support, said strut associated with said tubular left forearm support is inserted into said tubular left forearm support, said strut associated with said tubular right handgrip is inserted into said tubular right handgrip, and said strut associated with said tubular left handgrip is inserted into said tubular left handgrip.

12. The device of claim 1 wherein said mat extends from said right forearm support to said left forearm support.

13. A step-through modular device for assisting a person to rise from a sitting position to a standing position and for assisting said person to lower from a standing to sitting position, said modular device in a kit comprising:

a mat to be stood upon and having a non-skid top surface;

a plurality of floor rails attached to and extending beyond said mat;

a plurality of forearm supports attached to said floors rails;

a plurality of hand grips attached to said floor rails, said grips attached to said forearm supports and terminating in sleeves which extend upwardly beyond said forearm supports; and a brace connecting said forearm supports.

14. The device of claim 13 wherein said brace is connected to said forearm supports at their lower portions below the waist level of the user so as to allow said user to walk through said device.

15. The device of claim 14 wherein said brace connecting said forearm supports is located rearwardly of said device.

16. The device of claim 13 wherein said mat extends from said right forearm support to said left forearm support.

* * * * *